United States Patent [19]

Yee et al.

[11] Patent Number: 4,967,174

[45] Date of Patent: Oct. 30, 1990

[54] ROTATING COAXIAL SWITCH

[75] Inventors: Harold H. Yee, Rancho Palos Verdes; James F. Hudson, Manhattan Beach, both of Calif.

[73] Assignee: Hughes Aircraft Company, Los Angeles, Calif.

[21] Appl. No.: 397,608

[22] Filed: Aug. 23, 1989

[51] Int. Cl.[5] ..... H01H 53/00

[52] U.S. Cl. ..... 335/5; 333/105

[58] Field of Search ..... 335/5; 333/105, 106, 333/107, 108, 110

[56] References Cited

U.S. PATENT DOCUMENTS 3,157,844 11/1964 Lanctot ..... 333/108

4,779,066 10/1988 Chapell ..... 335/5

*Primary Examiner*—Leo P. Picard

*Assistant Examiner*—Lincoln Donovan

*Attorney, Agent, or Firm*—Robert A. Westerlund; Steven M. Mitchell; Wanda K. Denson-Low

[57] ABSTRACT

The rotating coaxial switch first lifts the switching circuitry, including portions of the ground plane, rotates it to a new position, and then lowers the switching circuitry in the new position to make new connections. Rotation is by a stepper motor. Lifting is by any convenient solenoid. Both these functions (lift and rotate) can be combined in a single actuator module. Development and use of a combination actuator module reduces the size and weight of the switch.

20 Claims, 3 Drawing Sheets

ROTATING COAXIAL SWITCH

FIELD OF THE INVENTION

The present invention is directed to several embodiments of switches for switching between several coaxial microwave ports.

BACKGROUND OF THE INVENTION

In order to provide redundancy in systems, extra system components are provided. Switching is required between these components in order to switch out some of the components out of the system and switch others into the system. In communication satellites, redundant traveling wave tubes may be installed. In other environments where it is difficult to provide maintenance, such redundancy is also suggested. In those cases where interruptions to service are undesirable, redundancy can be provided so that automatic switching maintains continuity of service until maintenance of inactive components can be accomplished. To permit such redundancy, switching between components is required.

The switching of microwave networks has not been as highly developed as the switching in lower frequency systems. Both air-line and strip-line reversing switches are known. Air-line switches tend to be more reliable and less lossy than the alternative strip-line switches, as presently developed. The loss in strip-line switches is in the dielectric. In addition, the strip-line switches are more sensitive to thermal variations, making it more difficult to match the switch to the incoming and outgoing transmission lines. The presently available switches are fairly heavy in weight and limited in power. With increasing power transmission, a reliable switch is required. With utilization of such switches in environments where light weight is desirable, a lightweight configuration of such a switch is also helpful.

SUMMARY OF THE INVENTION

In order to aid in the understanding of this invention, it can be stated in essentially summary form that it is directed to a rotating coaxial switch wherein contact posts extend into a cavity and conductor bars are in direct physical contact therewith. To change switching, the conductor bars are raised away from the contact posts and the conductor bars are moved, preferably rotated, to a new position at which they are lowered back into contact with the contact posts to make a new circuit connection.

It is thus a purpose and advantage of this invention to provide a coaxial switch wherein connector extend into a cavity and one or more conductor bars physically engage with the posts to make contact therebetween. When switching is desired, the conductor bars are raised and moved to a new set of contact posts, at which position the conductor bars are lowered to make contact with the posts and make a new switching connection. Such a structure is particularly useful when designing a lightweight switch for transmitting relatively high power with weight limitations on the design thereof.

Other purposes and advantages of this invention will become apparent from a study of the following portion of this specification, the claims and the attached drawings wherein:

DESCRIPTION OF THE PREFERRED EMBODIMENTS

Figure 1:
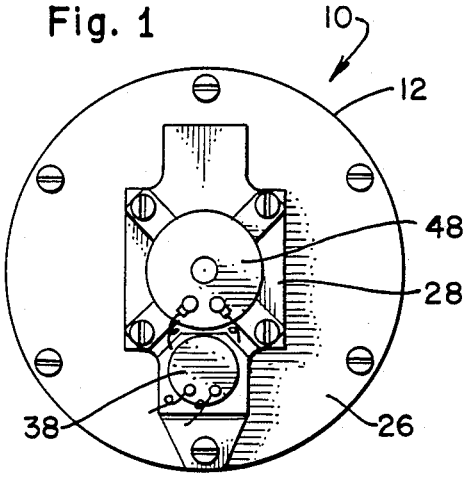
FIG. 1 is a plan view of the first preferred embodiment of the rotating coaxial switch of this invention.
Figure 2:
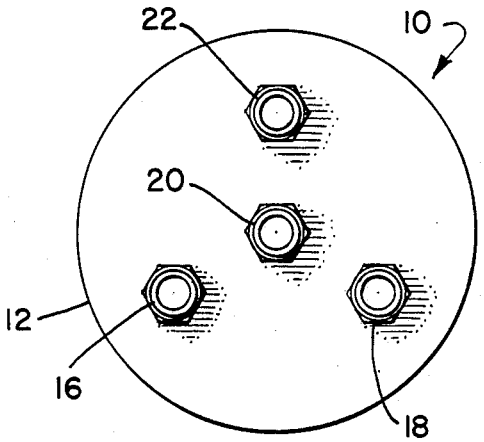
FIG. 2 is a bottom view thereof, showing the four coaxial cable connectors thereon.
Figure 3:
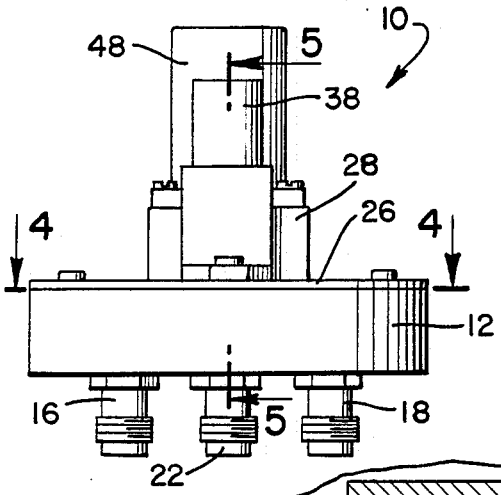
FIG. 3 is a side-elevational view of the switch of FIG. 1.
Figure 4:
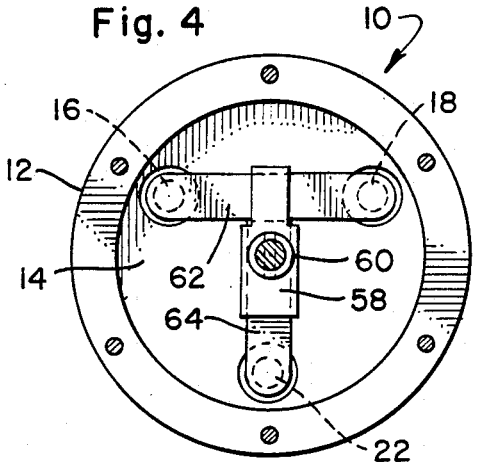
FIG. 4 is a downwardly looking view, as seen generally along line 4—4 of FIG. 3.
Figure 5:
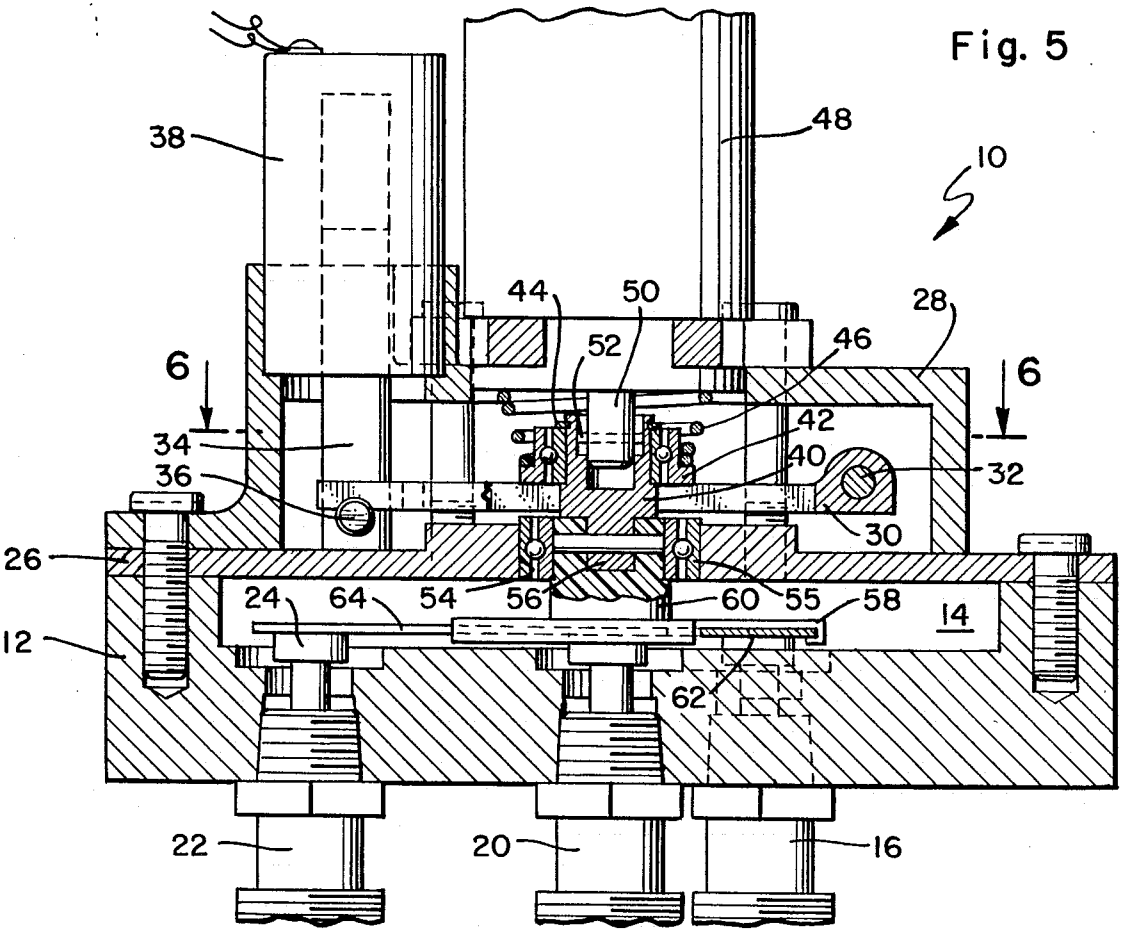
FIG. 5 is an enlarged section taken generally FIG. 3 with parts broken away and parts taken in section.

FIGS. 1–6 show the first preferred embodiment of the rotating coaxial switch of this invention. The switch is generally indicated at 10 in FIGS. 1–5. The switch 10 includes a housing 12 which is of generally circular configuration. The housing 12 has a circular cavity 14 therein. Four connectors 16, 18, 20 and 22 are attached through the bottom of the housing and extend into the cavity. The four connectors are the same, and their attachment to the housing is best shown in FIG. 5. The connector 22 is shown as being threaded into the housing. The housing is metallic to serve as a ground plane. The connector 22 is a body to which the outer conductor of a coaxial cable is attached. The inner conductor of the coaxial cable connects to the post 24. The post 24 is a center conductor of the connector fitting and is connected to the center conductor of the coaxial cable. The contact post extends above the floor of the cavity 14. Metallic cover 26 closes the cavity.

Figure 6:
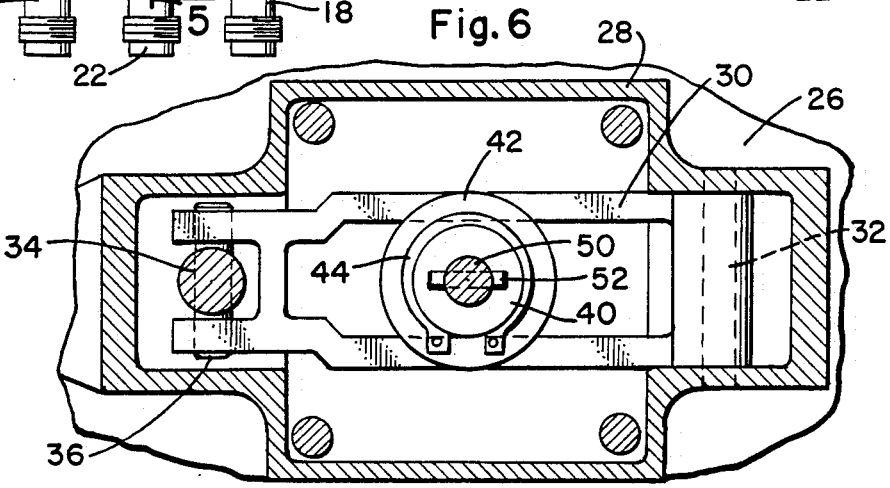
FIG. 6 is a downwardly looking view, as seen generally along 6—6 of FIG. 5.

Actuator housing 28 is attached to cover 26 on the top of the switch housing 12. Lifting lever 30 is pivoted within housing 28 on cross pin 32, see FIG. 5. Lifting lever 32 extends through housing 28 and is lifted by solenoid plunger 34. Solenoid cross pin 36 passes through a transverse hole in plunger 34 and is positioned underneath the lifting lever, as seen in FIGS. 5 and 6. Solenoid 38 can be energized to lift plunger 34 and lever 30. The downward limit of lever 30 is defined by the de-energized return stroke of plunger 34.

Lifting lever 30 is bifurcated, and upper collar 40 is engaged through the fingers of bifurcation. Ball bearing 42 is mounted on the collar 40 above the fingers of the lift lever. Compression spring 46 urges the bearing 42 in the downward direction. Stepper motor 48 is carried on actuator housing 28. It has a shaft 50 which rotates about its longitudinal axis, but does not translate along that axis. Shaft 50 extends into a hole within the upper collar 40, and drive pin 52 (see FIG. 6) engages through the shaft and lies within a corresponding slot in the collar. In this way, the collar can be rotated by the stepper motor and can be raised by the lifting lever 30. Its downward position is defined by the plunger 34 de-energized stroke limit, as shown in FIG. 5.

Ball bearing 55 is axially slidable in an opening 54 in cover 26. Dielectric conductor holder 58 has a lower collar 60 which extends upward within bearing 55 to engage around nose 56. A pin, seen in FIG. 5, engages thereacross to lock the conductor holder to the collar 40. As is seen in FIG. 4, two metallic conductors 62 and 64 are held by holder 58. These conductors are the conductive portions of the switch by which electrical contact is made between adjacent connector posts. Conductor 64 is radially positioned and extends from the center post on connector 20 to one of the outer posts, for example the post on connector 22, as seen in FIG. 4. When the switch is oriented in that position, the conductor 62 contacts the posts in connectors 16 and 18. This is the position shown in FIGS. 4 and 8.

Figure 7:
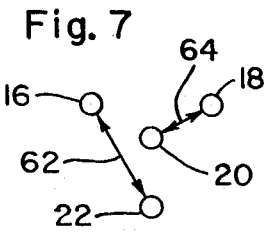
FIG. 7 switch of FIG. 1 in the first position.
Figure 8:
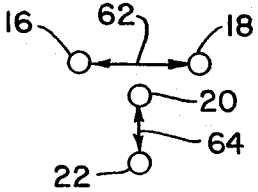
FIG. 8 is a view similar to FIG. 7 showing the switch in the second position.
Figure 9:
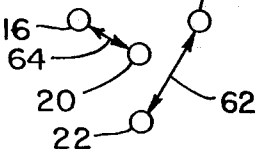
FIG. 9 is a view similar to FIG. 7 showing the switch in the third position.

Switching can be achieved by lifting the conductors 62 and 64 out of contact with the posts on the connectors. Raising the conductors is accomplished by energizing solenoid 38, which pulls in its plunger and rocks lifting lever 30 in the upward direction in FIG. 5. This raises the collar 40 and the conductor holder 58, together with its conductors. Once raised, motor 48 is energized to rotate the conductors to the new, selected position. As is seen in FIGS. 7 and 8, a 120 degrees counterclockwise rotation of the motor places the conductors 62 and 64 in the position shown in FIG. 7. The solenoid is deenergized, and the conductors are lowered into contact with the connectors at the same level shown in FIG. 5. This makes the switch connections shown in FIG. 7. In similar manner, the conductors 62 and 64 can be raised away from the posts of the connectors and the conductor holder 58 can be rotated 120 degrees clockwise from the position shown in FIG. 8 so that the conductors are in the position of FIG. 9. Thereupon, de-energization of the solenoid makes contact between the connectors to create continuity, as shown in FIG. 5. While a T-shaped arrangement of the connectors and conductors is shown, it is clear that the lifting and rotational mechanism, as described with respect to FIGS. 1–6, can also be employed with other connector and conductor arrangements to achieve different switching arrangements. Spring 46 thrusts down upon collar 40.

Figure 10:
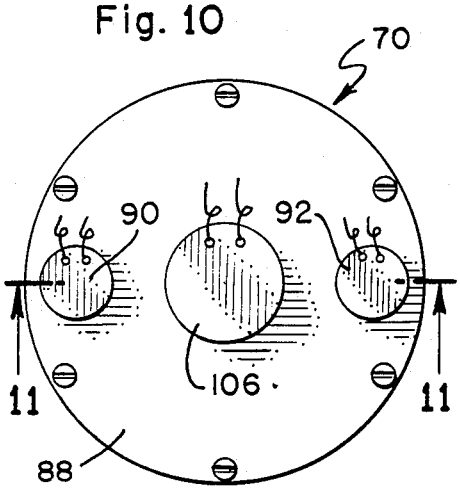
FIG. 10 is a plan view of the second preferred embodiment of the rotating coaxial switch of this invention.
Figure 12:
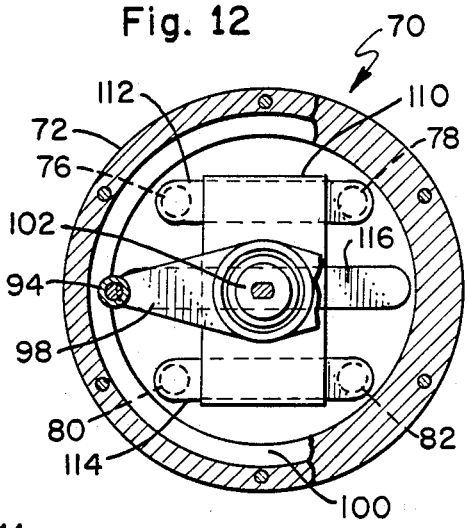
FIG. 12 is a downwardly looking view in the cavity of the switch of FIG. 10, as seen generally along the line 12—12 of FIG. 11, on the same scale as FIG. 10.
Figure 11:
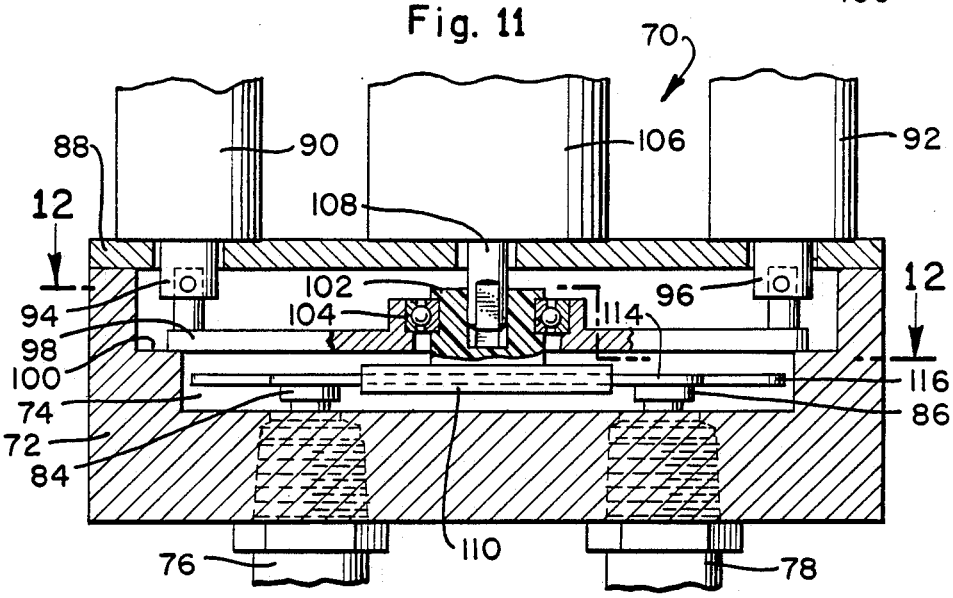
FIG. 11 is an enlarged sectional view, as seen generally along the line 11—11 of FIG. 10, with broken away.

The second preferred embodiment of the rotating coaxial switch of this invention is generally indicated at 70 in FIGS. 10, 11 and 12. Switch 70 has a housing 72 which is the switch body and is metallic to serve as a ground plane. Cavity 74 is formed in the housing. Four coaxial connectors are orthogonally arranged. The connectors are screwed into openings in the bottom of the housing to extend into the cavity. Two of the connectors are indicated at 76 and 78 in FIG. 11. These are beyond the center line plane of FIG. 11. The two connectors 80 and 82 are shown in FIGS. 12, 13, 14 and 15 wherein their contact posts are seen in dotted lines. The four connectors are the same, and at their lower ends, as the connectors are seen in FIG. 11, the connectors are arranged to couple to coaxial conductor cables. The outer sheath of the cable is connected through the connectors to the housing 72, which serves as a common ground plane. The center conductors of the coaxial cables terminate in contact posts 84 and 86. There also are contact posts on the other two connectors.

The housing 72 and its cavity 74 are closed by metallic cover 88. Solenoids 90 and 92 are mounted on cover 88 and respectively receive plungers 94 and 96. The plungers are attached to lifting lever so that, when the plungers are energized, the lifting lever is raised. In the deenergized position, the lifting lever rests upon shoulder 100 around the edges of the cavity. It is this shoulder which establishes the unactuated or rest position of the lifting lever. Collar 102 is rotatably mounted in the lifting lever on ball-bearing 104 so that the collar can rotate with respect to the lifting lever, but is axially fixed with respect thereto. Stepper motor 106 has its shaft 108 axially slidably mounted in the collar 102, but is irrotatable therein by reason of a flat, key or spline interconnecting the collar and shaft. The collar thus rises when the solenoids 90 and 92 are energized, and the collar rotates when the motor rotationally drives it.

Figure 15:
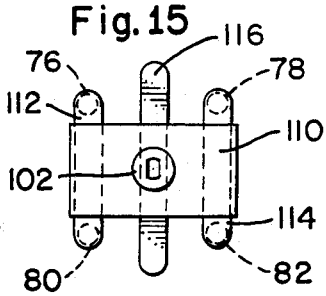
FIG. 15 is a view similar to FIG. 13 showing the contacts in the third position.

Dielectric conductor holder 110 is carried on the lower end of collar 102. At least conductors 112 and 114 are mounted on the conductor holder. These conductors are sized and positioned so that, when in the position shown in FIGS. 11, 12 and 13, the conductor 110 spans the posts on connectors 76 and 78 and the conductor 114 spans the posts on connectors 80 and 82. In the unactuated condition of the solenoids 90 and 92, the lifting lever 98 rests upon the shoulders in the housing, and the contact pressure of the conductors on the connector posts is controlled by the dimensions and the flexibility of the conductors. In this way, contact pressure can be controlled. Switching can be achieved by energizing the solenoids 90 and 92 to raise the conductors away from the connector posts, energizing the motor to rotate the conductor holder and the conductors thereon (for example 90 degrees, as shown in FIG. 15), and then release of the solenoids to lower the conductors it is from FIG. 13 to FIG. 15, the conductor 112 now spans the post on connectors 76 and 80 while the conductor 114 spans the post on connectors 78 and 82. In this way, switching is achieved.

Figure 13:
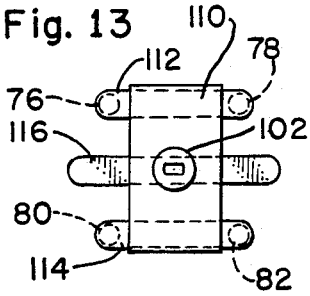
FIG. 13 is a diagrammatic view of the first position of the contacts of the switch of FIG. 10.
Figure 14:
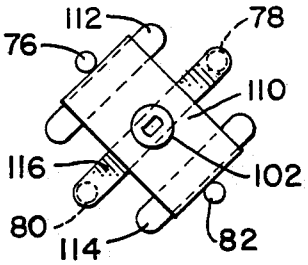
FIG. 14 is a view similar to FIG. 13 showing the contacts in the second position.

By providing an additional conductor 116, rotation of the conductor holder 110 through an angle of 45 degrees from the position of FIG. 13 permits the conductor 116 to diagonally connect with the posts on diagonally opposite connectors. For example, in FIG. 14, the rotation is 45 degrees counterclockwise so that the conductor 116 is over the post of connectors 78 and 80. In this way, diagonal connection can be achieved.

The parallel conductors 112, 114 and 116 may be subject to crosstalk between the adjacent channels. If required, such crosstalk can be reduced by adding a common side wall between the conductors to separately define the channels.

The specified structure of a switch which lifts the conductors, then rotates them to a new position, and then lowers them enables the use of simpler and smaller circuitry. The connectors are all on the same side of the switch housing to result in a more compact switch to perform the required switching operations.

This invention has been described in its presently contemplated best mode, and it is clear that it is susceptible to numerous modifications, modes and embodiments within the ability of those skilled in the art and without the exercise of the inventive faculty.

Accordingly, the scope of this invention is defined by the scope of the following claims.

What is claimed is:

1. A rotating switch comprising:

a housing having a cavity therein;

a plurality of contact posts extending into said cavity;

at least one conductor positioned within said cavity so that said conductor can lie at a first position where it contacts a first pair of said posts and can lie in a second position wherein it contacts a second pair of said posts;

means for raising said conductor away from said first pair of posts;

means for moving said conductor from its first to its second position; and means for lowering said conductor into contact with said second pair of posts.

2. The rotating switch of claim 1 wherein said housing is metallic.

3. The rotating switch of claim 2 wherein said posts are the center posts of a coaxial connector and there is a metal cover on said housing so that said cavity is enclosed.

4. The rotating switch of claim 1 wherein said conductor is mounted on a collar and a solenoid is connected to move said collar to lift said conductor out of contact with said connector post and so that said solenoid can lower said conductor into contact with said connector post.

5. The rotating switch of claim 4 further including a motor connected to said collar to rotate said collar so that when said conductor is lifted by said solenoid, said motor can move said conductor from a position where it is adjacent said first pair of contacts to a position where it is adjacent said second pairs of contacts, and said solenoid can move said conductor into contact with said second pair of connector posts.

6. The rotating switch of claim 5 wherein said connectors are connectors configured to receive coaxial cables and wherein said connector posts are for respective connection to the center conductor of the coaxial cables.

7. The rotating switch of claim 6 wherein there are at least two spaced conductors mounted on said collar so that two pairs of contacts are disconnected by raising said conductors and two pairs of contacts are engaged by lowering of said conductors.

8. A rotating coaxial switch comprising:

a housing, walls in said housing defining a cavity therein and a cover on said cavity having a wall enclosing said cavity, said walls defining said cavity being metallic to define a microwave cavity;

a plurality of coaxial connectors secured to said housing, each of said connectors having a connector post extending into said cavity, said connectors being arranged so that there is at least a first pair and a second pair of connector posts;

a motor mounted on said housing to define a rotational axis, said motor having a shaft rotating on said axis, a dielectric conductor holder mounted on said shaft, a conductor mounted on said dielectric conductor holder, said connector post being positioned within said cavity so that rotation of said conductor about said rotational axis to a first angular position positions said conductor adjacent a first pair of connector posts and rotation of said dielectric conductor holder to a second angular position positions said conductor adjacent a second pair of connector posts; and means connected to said dielectric conductor holder to move said conductor into and out of contact with said first pair of connector posts when said conductor holder is in its first angular position and for moving said conductor into and out of contact with said second pair of connector posts when said conductor holder is in its second angular position so that said conductor can be moved out of contact with a pair of posts and can be rotated to a new position and put in contact with another pair of connector posts to cause switching.

9. The rotating coaxial switch of claim 8 wherein there are four connector posts in said cavity and there are two separate conductors mounted on said dielectric conductor holder so that moving said conductor holder from its first angular position to its second angular position connects different pairs of connector posts.

10. The rotating coaxial switch of claim 8 wherein said means for lifting said dielectric conductor holder is a solenoid mounted on said housing with said solenoid connected so that solenoid energization moves said conductors from a position in contact with said connector posts to a position where said conductors are adjacent said conductor posts.

11. The rotating coaxial switch of claim 10 wherein said dielectric conductor holder is mounted on a collar and said motor shaft is axially slidably mounted in said collar and is irrotatably mounted in said collar and there is a lifting lever, said lifting lever being connected to said solenoid and said collar being rotatably mounted in said lifting lever so that actuation of said solenoid lifts said conductor away from said conductor post to permit rotation of said collar, said dielectric conductor holder and said conductor from said first angular position to said second angular position.

12. The rotating coaxial switch of claim 11 wherein said lifting lever has a raised position to which it is raised by energization of said solenoid and has a lowered position at which it lies during de-energization of said solenoid, said lowered position being limited by the stroke of the solenoid or a positive stop so that contact pressure of said conductor on said connector post is controlled.

13. The rotating coaxial switch of claim 8 wherein said two conductors on said dielectric conductor holder are arranged substantially parallel to each other and said connectors are arranged in a substantially square configuration.

14. The rotating coaxial switch of claim 8 wherein said conductors are arranged at right angles to each other and said contact pins are arranged with a center connector post on said axis and with three connector posts arranged substantially equi-angularly around said axis.

15. The rotating coaxial switch of claim 8 wherein said means for lifting comprises two solenoids connected to said lifting lever.

16. The rotating coaxial switch of claim 8 wherein said lifting lever has ends opposite said collar bearing therein and one of said ends is pivoted and the other end of said ends has said solenoid connected thereto, said solenoid connected end of said lever having a positive stop thereon to limit movement of said collar and said conductor carried by said collar toward said contact posts.

17. The rotating coaxial switch of claim 8 wherein said lifting lever has ends opposite said collar bearing and there are first and second solenoids connected to the ends of said lifting lever, said housing having a shoulder therein to limit movement of said lifting lever toward said connector post to control contact pressure between said conductor and said contact post.

18. The rotating coaxial switch of claim 17 wherein there are two said conductors arranged substantially parallel to each other and there are four of said connector posts arranged equi-angularly around said axis so that 90 degree rotation of said conductors changes connections between pairs of coaxial connector posts.

19. The method of switching between coaxial conductors wherein a plurality of rotating coaxial conductors terminate in posts in a housing cavity with a conductor within the cavity configured to contact different pairs of conductor posts comprising the steps of:

raising the conductor out of contact with a first pair of connector posts;

rotating the conductor around an axis; and lowering the conductor into contact with a second pair of connector posts to change switching between coaxial cables attached to a switch.

20. The method of claim 19 wherein there are two conductors in the cavity and the raising step comprises:

raising both of the conductors away from the connector posts with which they had been in contact;

rotating both of the conductors; and lowering both of the conductors back into contact with another pair of connector posts.

* * * * *